United States Patent [19]

Anderson et al.

[11] 4,328,088

[45] May 4, 1982

[54] CONTROLLED SHORT RESIDENCE TIME COAL LIQUEFACTION PROCESS

[75] Inventors: Raymond P. Anderson, Overland Park, Kans.; David K. Schmalzer, Englewood, Colo.; Charles H. Wright, Overland Park, Kans.

[73] Assignee: The Pittsburg & Midway Coal Mining Co., Englewood, Colo.

[21] Appl. No.: 182,698

[22] Filed: Sep. 9, 1980

[51] Int. Cl.[3] ..... C10G 1/00; C10G 1/06

[52] U.S. Cl. ..... 208/8 LE; 208/10

[58] Field of Search ..... 208/8 LE, 10

[56] References Cited

U.S. PATENT DOCUMENTS

| | | | |
|---|---|---|---|
| 3,075,912 | 1/1963 | Eastman et al. . | |
| 3,488,278 | 1/1970 | Nelson . | |
| 3,503,864 | 3/1970 | Nelson . | |
| 3,594,304 | 7/1971 | Seitzer et al. . | |
| 3,617,465 | 11/1971 | Wolk et al. | 208/8 LE |
| 3,671,418 | 6/1972 | Gatsis . | |
| 3,726,785 | 4/1973 | Keller et al. . | |
| 3,884,794 | 5/1975 | Bull et al. | 208/8 LE |
| 3,884,796 | 5/1975 | Hinderliter et al. . | |
| 3,947,346 | 3/1976 | Snell et al. | 208/10 |
| 3,997,422 | 12/1976 | Bull et al. | 208/8 LE |
| 4,045,328 | 8/1977 | Green et al. . | |
| 4,094,765 | 6/1978 | Bearden, Jr. et al. . | |
| 4,119,523 | 10/1978 | Baldwin et al. . | |
| 4,133,646 | 1/1979 | Farcasiu et al. . | |
| 4,152,244 | 5/1979 | Raichle et al. | 208/10 X |
| 4,189,374 | 2/1980 | Kirby et al. | 208/8 LE |
| 4,190,518 | 2/1980 | Giannetti et al. | 208/10 X |
| 4,219,403 | 8/1980 | Nakako et al. | 208/10 |

OTHER PUBLICATIONS

"Development of a Process for Producing Ashless, Low-Sulfur Fuel from Coal", R and D Report No. 53, Interim Report No. 7, vol. II, Part 2, (ERDA) Sep. 1975.

"Monthly Progress Report No. 66", Mar. 1972 (10 pages and Appendices A-D comprising over 100 pages).

"Short Residence Time SRC I: Background and Recent Work", C.H. Wright and D.K. Schmalzer, presented Mar. 21, 1979 at DOE Contract Review Mtg., Oak Ridge, Tenn.

"Short Residence Time Coal Liquefaction", AMERICAN CHEMICAL SOCIETY, vol. 24, No. 2, Apr. 2-6, 1979, Longanbach, Droege and Chauhan.

"Short Residence Time Coal Liquefaction", AF-780 Research Project 779-5, Longanbach, Droege and Chauhan.

"Liquefaction of Coal in Hydrogen-Donor and Non-Donor Vehicles", FUEL, vol. 55, Jul. 1976, Neavel.

*Primary Examiner*—Delbert E. Gantz

*Assistant Examiner*—William G. Wright

*Attorney, Agent, or Firm*—Deane E. Keith; Forrest D. Stine; Alvin E. Ring

[57] ABSTRACT

Normally solid dissolved coal product and a distillate liquid product are produced by continuously passing a feed slurry comprising raw feed coal and a recycle solvent oil and/or slurry together with hydrogen to a preheating-reaction zone (26, alone, or 26 together with 42), the hydrogen pressure in the preheating-reaction zone being at least 1500 psig (105 kg/cm$^2$), reacting the slurry in the preheating-reaction zone (26, or 26 with 42) at a temperature in the range of between about 455° and about 500° C. to dissolve the coal to form normally liquid coal and normally solid dissolved coal. A total slurry residence time is maintained in the reaction zone ranging from a finite value from about 0 to about 0.2 hour, and reaction effluent is continuously and directly contacted with a quenching fluid (40, 68) to substantially immediately reduce the temperature of the reaction effluent to below 425° C. to substantially inhibit polymerization so that the yield of insoluble organic matter comprises less than 9 weight percent of said feed coal on a moisture-free basis. The reaction is performed under conditions of temperature, hydrogen pressure and residence time such that the quantity of distillate liquid boiling within the range $C_5$-455° C. is an amount at least equal to that obtainable by performing the process under the same conditions except for a longer total slurry residence time, e.g., 0.3 hour. Solvent boiling range liquid is separated from the reaction effluent and recycled as process solvent.

26 Claims, 6 Drawing Figures

TOTAL DISTILLATE YIELD AS A FUNCTION OF RESIDENCE TIME

TOTAL DISTILLATE YIELD AS A FUNCTION OF TEMPERATURE

HYDROGEN REQUIREMENT AS A FUNCTION OF TEMPERATURE $C_1 - C_4$ YIELD AS A FUNCTION OF TEMPERATURE

NAPHTHA YIELD AS A FUNCTION OF TEMPERATURE

CONTROLLED SHORT RESIDENCE TIME COAL LIQUEFACTION PROCESS

The Government of the United States of America has rights in this invention pursuant to Contracts Nos. DE-AC01-79ET4800 and DE-AC05-78OR03055 awarded by the U.S. Department of Energy to The Pittsburg & Midway Coal Mining Co., a subsidiary of Gulf Oil Corporation.

CROSS-REFERENCE TO RELATED APPLICATION

Reference is made to the following U.S. application filed on even date and which is hereby incorporated by reference: U.S. patent application Ser. No. 182,697 to Raymond P. Anderson, David K. Schmalzer and Charles H. Wright entitled "Short Residence Time Coal Liquefaction Process Including Catalytic Hydrogenation".

FIELD OF THE INVENTION

This invention relates to a short residence time coal liquefaction process for producing reduced or low ash hydrocarbonaceous solid fuel from ash-containing crushed raw coal. More particularly, this invention relates to a coal liquefaction process wherein sufficient solvent boiling range liquid is obtained to substantially maintain the overall process in solvent balance.

DESCRIPTION OF THE PRIOR ART

Prior processes for producing ash-free hydrocarbonaceous solid fuel from coal dissolve raw feed coal in a hydrocarbonaceous solvent under elevated temperatures and pressures in the presence of hydrogen. Suspended undissolved solids are then removed by filtration, solvent deashing or other solid-liquid separation step, and the solids-free liquid is then distilled to recover a naphtha fraction and a fraction comprising solvent boiling range liquid, leaving as a residue a low-sulfur ashless product, which is solid at room temperature and generally known as solvent refined coal.

A characteristic feature of such a process is the possible loss of a significant portion of the solvent by either polymerization or hydrocracking reactions, while some of the coal is dissolved or hydrocracked to a liquid boiling within a range about the same as the original solvent. The quantity of solvent obtained from the feed coal should be at least equal to the quantity of feed solvent which is lost. If the net solvent obtained is less than zero, the process is not in balance.

The major product of the process is a deashed solid fuel rather than liquid fuel. Thus, solvent boiling range liquid is not a significant net product. When less than the required amount of solvent is obtained, increased solvent can be achieved by increasing the rate of hydrocracking reactions, by increasing hydrogen pressure, hydrogen circulation rate, residence time or by changing the solvent to coal ratio; however, such means are usually very costly. Another means for increasing the rate of hydrogenation or hydrocracking of coal involves increasing the reaction temperature, which will generally increase the overall reaction rate and is one of the lowest cost means for doing so. However, because of excessive coking and attendant loss of yield there is a practical limit to the extent that an increase in temperature can be used to increase the overall rate of reaction. Thus, for example, an increase in temperature from 425° C. to 450° C. can increase the total distillate yield under conditions normally used in a solvent refined coal process, but a further increase in temperature to 475°0 C. can result in a decrease in total distillate yield. Similarly, as the temperature is increased within a particular range, the net solvent can become increasingly negative, i.e., increasingly below the amount needed for overall solvent balance.

The decrease in total distillate yield and recycle solvent obtained as the temperature is increased from 450° C. to 475° C. apparently occurs because the rate of hydrocracking of liquids to gases and the rate of polymerization of dissolved coal to insoluble organic matter both increase significantly in such temperature range. While the overall rate of conversion of feed coal increases, much of this increase involves hydrocracking to gases and polymerization to insoluble organic matter. Thus, merely increasing the temperature may not provide sufficient process-derived solvent to keep the overall process in solvent balance.

SUMMARY OF THE INVENTION

It has now been found that sufficient amounts of solvent boiling range liquid can be obtained to maintain an overall solvent balance in a coal liquefaction process for producing deashed, normally solid hydrocarbonaceous fuel by utilizing selected temperatures and hydrogen pressures equivalent to or greater than those commonly employed, but at short residence times. The deashed, normally solid hydrocarbonaceous fuel will be referred to in this application as "normally solid dissolved coal", "deashed coal", "solid deashed coal" or similar designation.

The process of the present invention comprises continuously passing a slurry comprising coal and solvent oil together with hydrogen through a preheating-reaction zone, the hydrogen pressure in said preheating-reaction zone being at least about 1500 psig (105 kg/cm$^2$), e.g., between about 1500 and about 4000 psig (105 and 129 kg/cm$^2$), preferably between about 1850 or 1900 and about 3000 psig (129 or 133 and 210 kg/cm$^2$), with between about 2000 and about 3000 psig (140 and 210 kg/cm$^2$) being especially preferred. The feed slurry is reacted in the preheating-reaction zone at a temperature in the range of between about 455° and about 500° C., preferably between about 460° and about 500° C., especially between about 465° and about 490° C., to dissolve the coal in the liquid portion of the slurry to form coal-derived liquid and normally solid dissolved coal. The total slurry residence time is maintained at a finite value in the range from above 0 to about 0.2 hour, preferably between about 0.02 and about 0.15 hour, with between about 0.06 and about 0.135 hour being especially preferred. The high distillate liquid yield of the short residence time process of the present invention is transitory in nature and would be lost rapidly with increasing residence time due to hydrocracking and polymerization reactions. Thus, the slurry residence time must be strictly controlled at a predetermined value. The total slurry residence time is the time during which the reaction slurry is within the temperature range of this invention, and is based upon the total volume of the slurry, measured under ambient conditions, passing through the reaction assuming that the small volume occupied by gas is negligible. The total slurry residence time is continuously controlled by continuously and directly quenching the reaction effluent, i.e., direct intermixing of the reaction effluent with a quenching fluid to substantially immediately reduce the temperature sufficiently to substantially terminate or inhibit polymerization and hydrocracking reactions, e.g., to a temperature below about 425° C. or 370° C. The quenching reduces the reaction effluent temperature to a level at which the unstable, polymerizable compounds in the solvent boiling range liquid of the reaction effluent stream are stabilized. Just as quenching serves to conserve solvent boiling range liquid by inhibiting polymerization reactions, it concomitantly reduces the yield of IOM (insoluble organic matter), which is formed via polymerization reactions and reduces the yield of useful product. Therefore, it is a feature of this invention that the yield of IOM on an MF (moisture free) coal basis is always below 9 weight percent, is preferably below 8 weight percent and is most preferably below 7 or even 6 weight percent. A yield of IOM about 9 weight percent indicates that the quenching step was not performed in a timely manner. Cool distillate liquid is a suitable quench fluid. Hydrogen pressure, temperature and residence time are selected such that the reaction product will contain distillate liquid (liquid boiling in the range $C_5$–454° C. although not necessarily over the entire range, which includes solvent boiling range liquid and naphtha) in amount at least equal to that obtainable by performing the process at the same conditions, i.e., the same hydrogen pressure, temperature, etc., but at a longer total slurry residence time such as a residence time of 0.3, 0.4, 0.5, 0.6 hour or the like. Our discovery is remarkable because it teaches that a higher distillate yield can be achieved at a short rather than a long residence time, and even though the primary product fraction is normally solid dissolved coal so that the production of net liquid product is not encouraged.

The transitory (unstable) nature of the high distillate liquid yield at the short residence time makes it imperative that the slurry residence time be controlled and that quenching be utilized for this purpose. The reaction effluent may be separated into a fraction containing normally solid dissolved coal, a fraction containing mineral residence, a fraction comprising solvent boiling range liquid, e.g., boiling in the range of between about 177° and about 454° C., a lower boiling naphtha fraction and gases. The solvent boiling range liquid distillate is recycled as process solvent. The amount of solvent boiling range liquid obtained is sufficient to provide at least 80 weight percent, preferably at least 90 or 100 weight percent, of the amount required to maintain the process in overall solvent balance. Ordinarily, the required weight ratio of solvent to feed coal is between 1:1 and 4:1, preferably between 1.5:1 and 3:1.

Thus, it was surprising to discover that a process for converting raw coal to a product wherein the deashed, normally slid hydrocarbonaceous fuel product constitutes at least 30, 40 or 50 weight percent of the MF raw coal feed could be conducted for very short slurry residence times and terminated by direct quenching, and yet still provide sufficient distillate liquid to maintain the process substantially in overall solvent balance. In addition, we have now made the surprising discovery that the solvent boiling range liquid obtained under the high temperatur conditions of the process is not only of suitable quality for use as a recycle solvent despite its hydrogen-depleted condition, but is even of a superior quality for use as a solvent as compared to solvent oils which are produced at a lower temperature and are therefore richer in hydrogen. It was surprising to find that by recycling solvent boiling range liquid, the amount of recycle solvent obtained increased over that obtained using a single pass solvent produced in another process operated at a longer resident time. The expression "single pass solvent" as used in this application refers to solvent boiling range liquid obtained from a conventional coal liquefaction process operated at a longer residence time as compared with the present process (longer than 0.2 hour). A solvent obtained at a lower temperature and a longer residence time will be richer in hydrogen donor materials than the solvent obtained in the present process, because the higher temperatures of the present process tend to strip hydrogen from hydrogen donor molecules. Clearly, the ablilty of the recycle solvent of the present process to increase the yield of liquid product, as compared to a solvent which is richer in hydrogen, is surprising. Thus, the hydrogen-poor recycle solvent of this invention is recycled directly to the liquefaction zone without any further processing, such as catalytic or non-catalytic hydrogenation, and the present process does not employ any hydrogenation reaction zone downstream from the quenching step prior to separation of the product into desired fractions. Similarly, the solvent boiling range fraction recovered during the product separation is not subjected to hydrogenative reaction prior to recycle.

According to one embodiment of the present invention, the reaction effluent is passed from a first stage which is a heated stage, for example, a tubular zone, into an unheated second stage, namely, a reaction zone or dissolver, wherein the exothermic heat of hydrcracking reactions increases the reaction temperature to the desired level and maintains it there. Thereafter, the reaction effluent is quenched by direct injection of cool distillate liquid or other cooling fluid into the flowing reaction effluent stream to terminate polymerization reactions. The dissolver employed in the present invention may have a similar capacity than previously utilized, since the total slurry residence time is less than 0.20 hour, thereby reducing the need for a large capacity dissolver.

According to another embodiment of the present invention, the slurry comprising feed coal and solvent oil together with hydrogen is passed to a tubular zone wherein the slurry is heated and reacted, and the reaction effluent is quenched immediately after it is discharged from the tubular zone by direct injection cooling with a quench fluid, thus eliminating the need for the conventinal dissolver, which involves large and costly equipment.

According to still another embodiment of the present invention, recycle slurry (a stream comprising mineral residue, normally solid dissolved coal and solvent boiling range liquid) and a separate solvent boiling range liquid stream are both recycled to the coal liquefaction zone to achieve increased quantities of recycle solvent and improve desulfurization of the solid deashed coal product, while still producing a primary product comprising normally solid dissolved coal.

DESCRIPTION OF THE PREFERRED EMBODIMENTS

Figure 1:
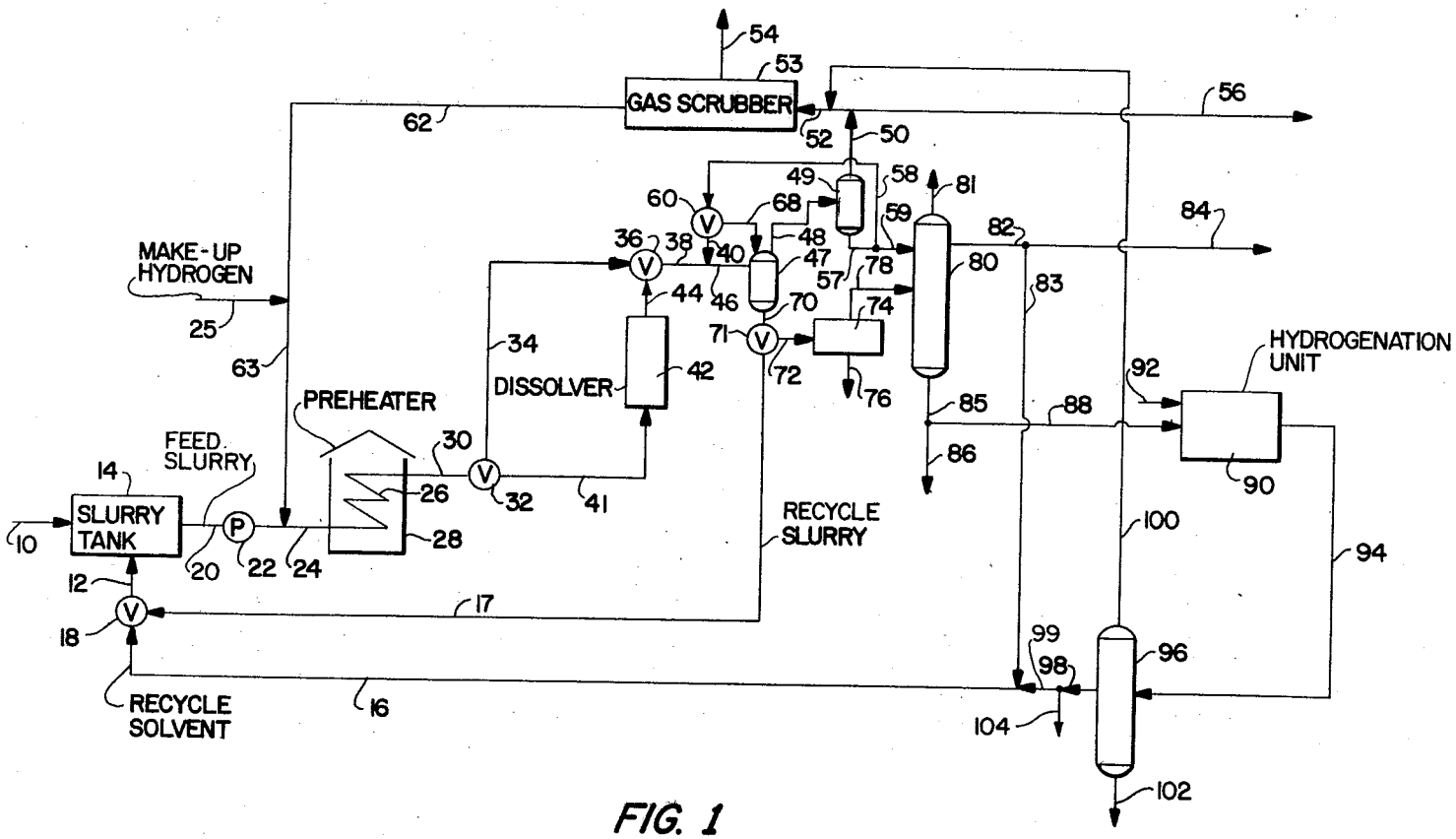
FIG. 1 is a schematic flow diagram of a process for the production of a substantially ash-free hydrocarbonaceous normally solid fuel product from coal in accordance with the invention.

As shown in the process set forth in FIG. 1 of the drawings, pulverized raw coal, which may be bituminous coal, subbituminous coal, or lignite, is charged to the process through line 10 and contacted in mixing tank 14 with recycle solvent boiling range liquid from line 12 to form a coal-solvent feed slurry. In the preferred operation of the process, an extraneous catalyst (non-feed coal derived) is not required. Thus, in its referred form, the present liquefaction process is conducted in the absence of an extraneous catalyst. In the embodiment where ash is recycled, it is ordinarily not necessary to render the ash more catalytic before it is recycled. As hereinafter discussed in detail, the solvent in line 12 comprises recycled solvent boiling range (about 177° to 454° C.) distillate from line 16, alone, or may additionally comprise recycle slurry from line 17, which is passed through valve 18 along with recycle solvent from line 16 in transit to line 12 and mixing tank 14. Feed slurry from tank 14 passes through line 20 and pump 22 and is mixed with recycle hydrogen from line 63 before passage through line 24 to preheater tube 26, which is disposed in furnace 28. The preheater tube 26 preferably has a high length to diameter ratio of at least 100 or 1000 or more.

The slurry is heated in furnace 28 to a temperature sufficiently high to initiate the exothermic reactions of the process and to enable the exothermic reactions to further heat the reaction mixture to a temperature of at least 455° C., e.g., in the range of between about 455° and about 500° C., preferably between about 460° or 475° and about 490° C. The hydrogen pressure in the preheater tube 26 is at least about 1500 psig (105 kg/cm$^2$), preferably between about 1850 or 1900 and 4000 psig (129 or 133 and 280 kg/cm$^2$), with between about 2000 and about 3000 psig (140 and 210 kg/cm$^2$) being preferred. The hydrogen feed rate is between about 0.5 and about 6.0, preferably between about 1.5 and about 4.0 weight percent based upon the weight of the slurry undergoing reaction.

The slurry undergoing reaction passes from furnace 28 by means of line 30, three-way valve 32, line 34, three-way valve 36, to line 38 wherein it is immediately force cooled by direct quenching with ay suitable quench fluid, such as cool, distillate liquid introduced from line 40, which cools the slurry and substantially terminates all reactions, especially polymerization and hydrocracking, by reducing the slurry temperature below that at which any significant polymerization takes place, e.g., below about 371° C. or 427° C. The quenching step continuously controls the effective reaction residence time of the slurry within short predetermined limits.

The forced cooling or quenching may be accomplished by means of any suitable cooling fluid, such as a cool distillate liquid stream obtained from the process, recycled hydrogen, or the like. A distillate liquid will ordinarily be more ecomomical than process hydrogen whose use increases the load on the hydrogen purification system. If distillate liquid is the quench fluid it can be continously introduced through line 40 to continuously provide direct injection cooling and thus maintain a controlled slurry residence time under reaction conditions of below about 0.2 hour, preferably between about 0.02 and about 0.15 hour, with between about 0.06 and about 0.135 hour being especially preferred.

Alternatively, the slurry in preheater coil 26 is passed through line 30, three-way valve 32 and line 41 to dissolver 42 wherein exothermic reactions proceed without added heat. The dissolver effluent slurry is then passed through line 44 and three-way valve 36 to line 38 wherein it is quenched as previously described within the predetermined short residence time of under 0.2 hour (12 minutes). The hydrogen pressure in dissolver 42 is substantially the same as the hydrogen pressure at the outlet of preheater tube 26.

The dissolver of the present invention has a capacity considerably below that commonly required heretofore because of the short total residence time required for the process, namely, less than 12 minutes within the temperature range of this invention. Thus, the slurry undergoing reaction is subjected to a total residence time of below about 12 minutes, which includes the residence time of the slurry within the temperature range of this invention both within the preheater and the dissolver zones. Although, as previously indicated, a dissolver is not required in the process of the present invention, a dissolver of reduced capacity can be employed to advantage, if desired, after the feed slurry reaches exothermic reaction conditions in the preheater. Thus, it is desirable to pass the reaction mixture undergoing exothermic reaction to a dissolver and permit continued reaction without adding heat prior to quenching. Additionally, the use of a dissolver reduces coking in preheater tubes, thereby maintaining a high heat transfer efficiency in the tubular equipment.

The quenched reaction mixture is thereafter passed by means of line 46 to high pressure separator 47. Unreacted hydrogen and hydrocarbon vapors are removed overhead from separator 47 through line 48 and are passed to separator 49 for separation of the normally liquid hydrocarbons from gaseous hydrocarbons and hydrogen. Separator 49 can comprise a series of condensers for removal of the hydrocarbons as a liquid. A hydrogen stream is removed from separator 49 through line 50 and may be discharged from the system via line 56, or may be passed by means of line 52 to gas purification zone 53, which may comprise scrubbers, for removal of impurities such as hydrgen sulfide, ammonnia and water vapor, which are discharged through line 54, and also may be passed through a cryogenic zone, not shown, for the removal of gaseous hydrocarbons, leaving a purified hydrogen stream for recycle by means of lines 62 and 63 to provide hydrogen to the feed slurry in line 24. Make-up hydrogen can be added as needed by means of line 25.

Cool distillate liquid is discharged from separator 49 through lines 57 and 58 and passed to three-way valve 60 and either line 40 or line 68 to provide a quench for the hot reaction product. A portion of the liquid in line 57 is passed by line 59 to distillation zone 80. If it is desired to quench the reaction effluent in separator 47, the reaction mixture in line 38 may be passed directly via line 46 to separator 47 without being quenched by cool distillate liquid in line 40 as previously described. In this case, the cool distillate liquid quench is introduced directly into separator 47 via line 68. Likewise, the reaction mixture may be quenched by concomitantly introducing cool distillate liquid quench from both line 40 and from line 68 into line 38 and separator 47, respectively.

A slurry containing normally liquid coal, normally solid dissolved coal, undissolved coal and coal minerals (ash) is removed from the bottom of separator 47 by means of line 70 and is passed by means of valve 71 and line 72 to solids separation zone 74, which may be a filtration zone or a solvent deashing zone wherein a solvent such as benzene or coal derived naphtha is used to separate the feed into a fraction soluble in the solvent at the separation conditions used and a fraction which is insoluble in the solvent at separation conditions. The insoluble fraction will contain essentially all of the coal minerals, i.e., ash, the latter being removed by means of line 76. If zone 74 is a filtration zone, stream 76 will comprise filter cake. If zone 74 is a solvent deashing zone, it can alternatively be located after distillation zone 80 in line 85.

The filtrate or solids-free solution from solids separation zone 74 is passed by means of line 78 to distillation zone 80, which may comprise an atmospheric distillation column or a vacuum distillation column or atmospheric and vacuum distillation zones disposed in series. Naphtha is removed from distillation zone 80 by means of line 81. Distillate liquid is removed from distillation zone 80 by means of line 82 and a portion of such material may be recovered as liquid product by means of line 84.

At least a portion of the distillate liquid in line 82 and generally all of such liquid within the solvent boiling range is passed by means of line 83 to line 16 for recycle to mixing zone 14 and used as recycle solvent as previously described. It was highly unexpected that a short residence time process, in which the major product is an ash-free, hydrocarbonaceous, normally solid fuel which is produced in an amount comprising at least 30 or 40 or 50 weight percent of the MF feed coal, could provide solvent boiling range liquid in an amount sufficient to maintain a solvent balance in the process. Also, the hydrogen requirement of the short residence time process of the present invention was considerably lower than expected and can be, for example, between about 0.5 or 1.0 and about 2.5 weight percent based upon the MF feed coal.

Although the short residence time process of the present invention can provide a breakeven amount of recycle solvent, such fact alone does not render a short residence time process commercially viable. In addition, the solvent boiling range liquid that is obtained from coal liquefaction directly, or from additional processing of distilate liquid, must be satisfactory for recycle purposes. Normally, it would be expected that solvent liquid produced under severe temperatures would be less satisfactory for recycle purposes because of a relatively low hydrogen to carbon ratio. However, not only can the process of the present invention provide sufficient recycle solvent for an overall solvent balance, but the recycle solvent produced is fully satisfactory for a continuous recycle despite a low hydrogen content. In fact, we have unexpectedly discovered that the recycle solvent balance actually improves by recycling solvent boiling range liquid produced in the process, as compared to employing a single pass solvent produced in another process performed at longer residence times. A possible explanation for the improved solvent recovery by employing solvent produced within the process is that the less refractory portions of the single pass solvent are replaced with more thermally stable structures which resist cracking to gases. The bottoms are removed from distillation column 80 by means of line 85 and upon cooling to room temperature, at which temperature such material solidifies, the resulting solid which constitutes substantially ash-free fuel may be recovered as the main product of the process by means of line 86. Alternatively, all or a portion of the normally solid hydrocarbonaceous product in line 85, containing sufficient normally liquid oil to make the stream pumpable, may be passed by means of line 88 along with hydrogen from line 92 to a conventional hydrogenation unit 90 for conversion to distillate liquid which may be recovered as an upgraded liquid fuel product of the process. No extraneous catalyst is employed in the process in advance of catalytic zone 90. If insufficient recycle solvent is obtained from line 82 of column 80 to maintain the process in overall solvent balance, normally solid hydrocarbonaceous material in line 85 may be converted to a hydrogen-enriched liquid which is suitable for use as recycle solvent in the liquefaction process of the present invention.

The normally solid hydrocarbonaceous product of the invention has a high benzene soluble content which renders it particularly amenable to hydrogenation including hydrocracking to solvent boiling range liquid. The benzene solubles constitute the lower molecular weight fraction of the solid deashed coal product and is measured as follows: A sample of normally solid hydrocarbonaceous product is placed in a porous thimble (Norton A 889 Alundum-Scientific Products Catalog No. E 6465-5). This thimble is placed in a Soxhlet Extractor (Corning No. 3740, Scientific Products No. E 6260-2) equipped with a condenser (Corning No. 3840). A heated round bottom flask is attached to the bottom of the extractor to serve as a reservoir for vaporizing the benzene. The benzene is boiled up from the flask, is liquified in the condenser, then passes through the sample in the thimble located in the Soxhlet Extractor. The components of the sample which are soluble in benzene are extracted as the benzene passes through the sample in the thimble. This is continued for a period of 28 hours to insure that all of the soluble components are removed. After the 28 hour period the heat is turned off and the sample remaining in the thimble is dried and weighed to determine the quantity of the material remaining. The difference between this quantity and the original weight of the sample is the benzene soluble portion of the sample.

The advantages of a higher benzene soluble feedstock in hydrocracking are described in U.S. Pat. No. 3,018,241 to E. Gorin, which is hereby incorporated by reference. Hydrocracking of the normally solid hydrocarbonaceous material in unit 90 accomplishes molecular weight reduction and also accomplishes desulfurization and denitrogenation. Hydrocracking in unit 90 may be conducted at a hydrogen pressure in the range of between about 1000 and about 5000 psig, (70 to 350 $kg/cm^2$) preferably between about 2000 and about 4000 psig (140 to 280 $kg/cm^2$), while at a temperature in the range of between about 370° and about 510° C., preferably between about 400° and about 480° C. using a suitable hydrogenation catalyst which may comprise, for example, supported Group VIB and Group VIII metals, as oxides and/or sulfides, such as NiW or CoMo on a cracking support such as alumina or silicalumina.

The effluent from hydrogenation unit 90 is passed by means of line 94 to distillation zone 96. Solvent boiling range liquid is withdrawn from zone 96 by means of line 98, a gaseous fraction is removed by means of line 100, and a bottoms fraction having a boiling point above the solvent boiling range liquid is withdrawn by means of line 102. The solvent boiling range liquid in line 98 is passed to line 99 and combined with recycle solvent from line 83 to make up any recycle solvent deficiency and to maintain the overall solvent balance of the process. The total recycle solvent is passed by means of line 16, valve 18 and line 12 to slurry tank 14 for admixture with raw coal. Any excess solvent boiling range liquid in line 98 can be removed as product through line 104. The gaseous hydrogen fraction in line 100 may be passed to line 52 for purification in zone 53.

If desired, a portion of the bottoms from separator 47 can be withdrawn by means of line 70 and passed by means of valve 71 and line 17 for admixture with recycle solvent present in line 16 to form a slurry recycle stream in line 12 for admixture with the raw coal in mixing zone 14. The amount of recycle slurry in line 17 is less than 75 weight percent based upon the total weight of the feed slurry, e.g., from about 0 to about 75, preferably between about 20 or 30 and about 70 weight percent. Likewise, the recycled solvent in line 16 utilized is between about 0 and about 70, preferably between about 0 and about 40 or 65 weight percent based upon the total weight of the feed slurry, while the feed coal constitutes between about 25 and about 50, preferably between about 30 and about 40 weight percent based upon the total weight of the feed slurry. Recycle of slurry can provide a higher amount of recycle solvent than is obtainable by recycle of solvent alone. Moreover, recycle of slurry as described greatly improves desulfurization of the normally solid dissolved coal product recovered in line 86. Thus, the use of recycle slurry in the short residence time process of the present invention results in both increased amounts of recycle solvent and improved desulfurization of the solid hydrocarbonaceous fuel product.

The following examples are not intended to limit the invention, but rather are presented for purposes of illustration. All percentages are by weight unless otherwise indicated.

EXAMPLE 1

Tests were conducted to compare the effect of temperature and pressure conditions upon the liquefaction of coal at low residence times utilizing as feed to the liquefaction reactor a coal from Western Kentucky having the following inspections:

| Elemental Analysis, wt. % (dry basis) | |
|---|---|
| Carbon | 71.2 |
| Hydrogen | 5.1 |
| Sulfur | 3.4 |
| Nitrogen | 1.5 |
| Oxygen | 7.4 |
| Ash | 11.4 |

Portions of the coal were admixed with a solvent obtained from a conventional solvent refined coal process performed at a longer residence time than that of the present process. The coal solvent slurry was subjected to liquefaction conditions of 450° and 475° C. at residence times of 4 minutes and 8 minutes, respectively, under a hydrogen pressure of 2000 psig and a hydrogen feed rate of 1.0 weight percent based on the slurry. The average yields for several runs at each of the foregoing conditions are set forth in Table I:

TABLE I

| | Yield, Wt. % Dry Coal Reactor Residence Times | |
|---|---|---|
| | 4 min. | 8 min. |
| Total Distillate | | |
| 450° C. | 7.8 | 11.4 |
| 475° C. | 11.1 | 14.5 |
| Recycle Solvent | | |
| 450° C. | −10.7 | −2.5 |
| 475° C. | −6.6 | +1.1 |
| Insoluble Organic Matter | | |
| 450° C. | 7.0 | 6.3 |
| 475° C. | 6.4 | 6.1 |
| $C_1$—$C_4$ | | |
| 450° C. | 1.1 | 1.2 |
| 475° C. | 2.3 | 4.1 |
| Benzene Solubles in Solid Deashed Coal, % by wt. | | |
| 450° C. | — | 57.0 |
| 475° C. | 58.6 | 63.5 |

The data in Table I show that the amount of recycle solvent obtained is not quite sufficient at 450° C. and a residence time of 8 minutes (−2.5) to provide a process which is self-sufficient in solvent. By increasing the temperature from 450° to 475° C. at a hydrogen pressure of 2000 psig (140 kg/cm$^2$) at an 8 minute residence time, the amount of recycle solvent is increased from slightly less than zero to an average excess of 1.1 weight percent, thus demonstrating a system which is not only in solvent balance, but wherein excess solvent is obtained. At a residence time of 4 minutes, at both 450° and 475° C. the amount of recycle solvent obtained is negative, i.e., insufficient solvent is provided by the system to maintain a solvent balance and the system requires an external source of solvent. However, the recycle solvent is closer to balance at 475° C. (−6.6) than at 450° C. (−10.7). Thus, the test results illustrate the advantage of high temperatures when operating at a low residence time.

Table I shows a further advantage of the present process since it shows that a temperature increase from 450° C. to 475° C. at a residence time of 8 minutes increases the benzene soluble content of the deashed normally solid coal product of the process from 50.8 weight percent to 63.5 weight percent. This is an advantage because the benzene solubles constitute the lower molecular weight fraction of the said deashed coal and are more amenable to conversion into recycle solvent by catalytic hydrogenation, than is non-benzene soluble material.

Figure 2:
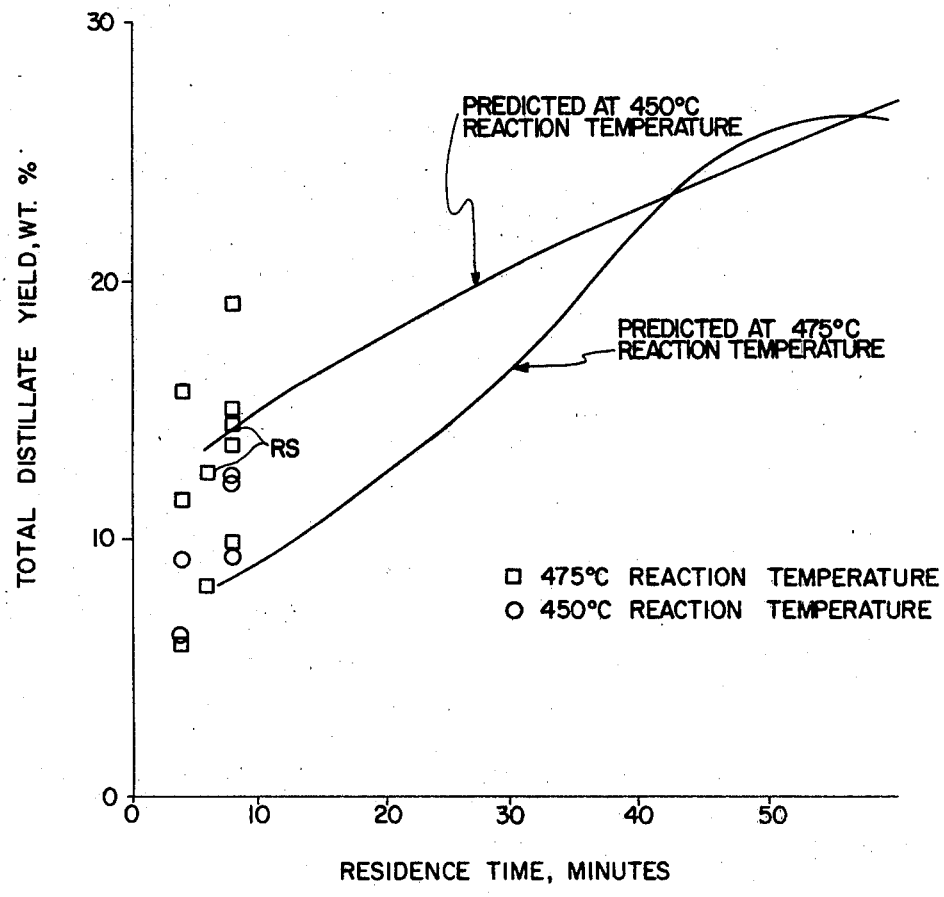
FIGS. 2 and 3 graphically illustrate the unpredictably high total distillate yields as a function of residence time and temperature, respectively, when operating in accordance with the short residence time process of the invention.

FIG. 2 graphically depicts total distillate yield as a function of residence time at reaction temperatures of 475° C. and 450° C., respectively, while operating at a hydrogen pressure of 2000 psig (140 kg/cm$^2$). The solid lines in FIG. 2 generally show distillate yields at residence times above the range of this invention. However, the isolated data points represent the average total distillate yield data in Table I for the 4 minute and 8 minute residence time runs. The actual data points denoted in FIG. 2 as "RS" were obtained using solvent recycled from the short residence time process of this invention. The remaining data points were obtained using a solvent obtained from a conventional solvent refined coal process. The solid portions of the curves in FIG. 2 were obtained by mathematical correlation based upon actual runs at numerous temperatures, and at residence time generally above the range of this invention.

The solid portions of the curves in FIG. 2 indicate that as residence time is increased, total distillate yield increases, presumably due to hydrocracking reactions. Thus, based upon the solid portions of the curves, which include conventional residence times which are longer than the residence times of this invention, it would be predicted that as the residence time is reduced towards zero, the total distillate yield would continue in its tendency to be reduced. In fact, FIG. 2 shows that when operating at a temperature of 450° C. and a hydrogen pressure of 2000 psig (140 kg/cm$^2$), the curve substantially follows the prediction, since the individual data points obtained when operating at 450° C. descend rapidly towards zero and are all below the 450° C. solid curve. However, in the case of the 475° C. curve, the predicted decline towards zero does not immediately occur. Instead, as residence time is decreased to the range below 0.2 hour, i.e., about 4 and 8 minutes, the total distillate yield exhibits sudden and steep increases, so that the actual distillate yield is much greater than predicted at these low residence times.

Similar beneficial effects of operation at short residence times were observed in the case of hydrogen consumption, $C_1$–$C_4$ yields and naphtha yield. The hydrogen consumption, naphtha yield and $C_1$–$C_4$ yields at short residence times are lower than predicted on the basis of the mathematical correlation. The lower hydrogen consumption is primarily a result of the lower yields of naphtha and $C_1$–$C_4$ fractions and is advantageous since the primary object of the process is to produce the normally solid dissolved coal product at a minimum cost in hydrogen.

Thus, FIG. 2 graphically demonstrates that the coal liquefaction process of this invention can be operated at very short residence times and still provide significant quantities of distillate of which recycle solvent is a significant fraction. Additionally, FIG. 2 demonstrates that distillate yield is greatly dependent upon the particular combination of temperature and residence time at the hydrogen pressure employed. FIG. 2 clearly demonstrates that when a high distillate yield is achieved at a given temperature and low residence time, the reaction effluent must be quenched very rapidly to preserve the high distillate yield. The graph shows that the high distillate yield is transitory (the distillate molecules are unstable) and will be rapidly lost with increasing residence time at reaction temperature even at times under 10 minutes.

It is interesting to note that although the low residence time advantage was achieved at 475° C., rather than 450° C., the solid curves of FIG. 2 indicate that at high residence times the 450° C. curve provides higher distillate yields than the 475° C. curve. It is noted that at very long residence times, the difference in distillate yield between the 450° C. and 475° C. curves, tends to disappear.

Although it is not intended to limit the present invention to any particular theory or mechanism, it appears that with increasing reaction temperatures the rate of formation of unstable free radicals in the distillate range increases and at high reaction temperatures the rate of free radical stabilization with hydrogen is generally not as fast as the rate of free radical formation. Therefore, the existance of the free radicals is transitory and with only a slight increase of reaction time the rate of free radical polymerization and/or hydrocracking will overtake the rate of free radical formation.

EXAMPLE 2

This example demonstrates the effect of further increasing reaction temperature.

Separate portions of bituminous coal of the type utilized in Example 1 were dissolved at temperatures of 475° and 490° C., employing residence times of 4 and 6 minutes, respectively, under a hydrogen pressure of 2000 psig (140 kg/cm$^2$) and a hydrogen feed rate of 1.0 weight percent based upon the weight of the slurry. The solvents utilized were the same as used in Example 1. The results are set forth in Table II:

TABLE II

| | Yield, Wt. % Dry Coal Reactor Residence Times | |
|---|---|---|
| | 4 min. | 6 min. |
| Total Distillate | | |
| 475° C. | 11.1 | 8.1 |
| 490° C. | 6.6 | 4.1 |
| Recycle Solvent | | |
| 475° C. | −6.6 | −7.1 |
| 490° C. | −12.3 | −12.3 |
| Insoluble Organic Matter | | |
| 475° C. | 6.4 | 6.2 |
| 490° C. | 6.7 | 7.5 |
| $C_1$—$C_4$ | | |
| 475° C. | 2.3 | 3.3 |
| 490° C. | 3.8 | 5.1 |
| Benzene Solubles in Solid Deashed Coal, % by wt. | | |
| 475° C. | 58.6 | 65.9 |
| 490° C. | 64.1 | 57.3 |

The data in Table II show that when the temperature is increased from 475° C. to 490° C. at residence times of 4 and 6 minutes, the amount of recycle solvent obtained and the total distillate yield decrease. Moreover, the yield of insoluble organic matter increases. This is in contrast to the increase in total distillate yields and decrease in insoluble organic matter which occurs when the temperature is increased from 450° to 475° C. In addition, in the 6 minute tests the benzene soluble portion of the normally solid product decreases from 65.9 weight percent to 57.3 weight percent. However, in the 4 minute residence time tests with an increase in temperature from 475° to 490° C., the amount of benzene solubles in the normally solid product is increased from 58.6 weight percent to 64.1 percent by weight. As indicated above, the benzene solubles were the portion of the solid product that is more readily catalytically hydrocracked to distillate liquids.

Figure 3:
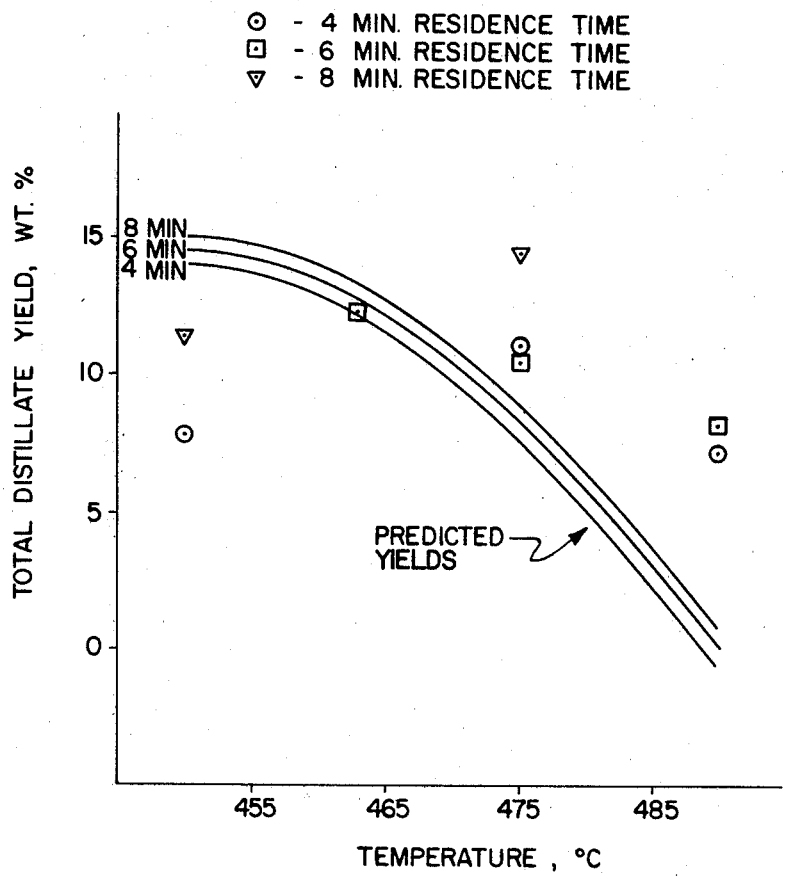

FIG. 3 graphically depicts total distillate yield as a function of temperature at residence times of 4, 6 and 8 minutes, respectively, while operating at a hydrogen pressure of 2000 psig (140 kg/cm$^2$) and a hydrogen feed rate of 1.0 weight percent based upon the weight of the feed slurry. The solid portions of the curves in FIG. 3 were obtained by mathematical correlation as in the case of FIG. 2. The isolated data points represent the average total distillate yield data in Tables I and II, above.

The solid curves in FIG. 3, which are the total distillate yields predicted by mathematical correlation, indicate that total distillate yield steadily decreases at short residence time with increasing temperature. However, the actual data indicate that the total distillate yield increases to a maximum at about 475° C., which is higher than predicted, and then decreases less rapidly than predicted.

Figure 4:
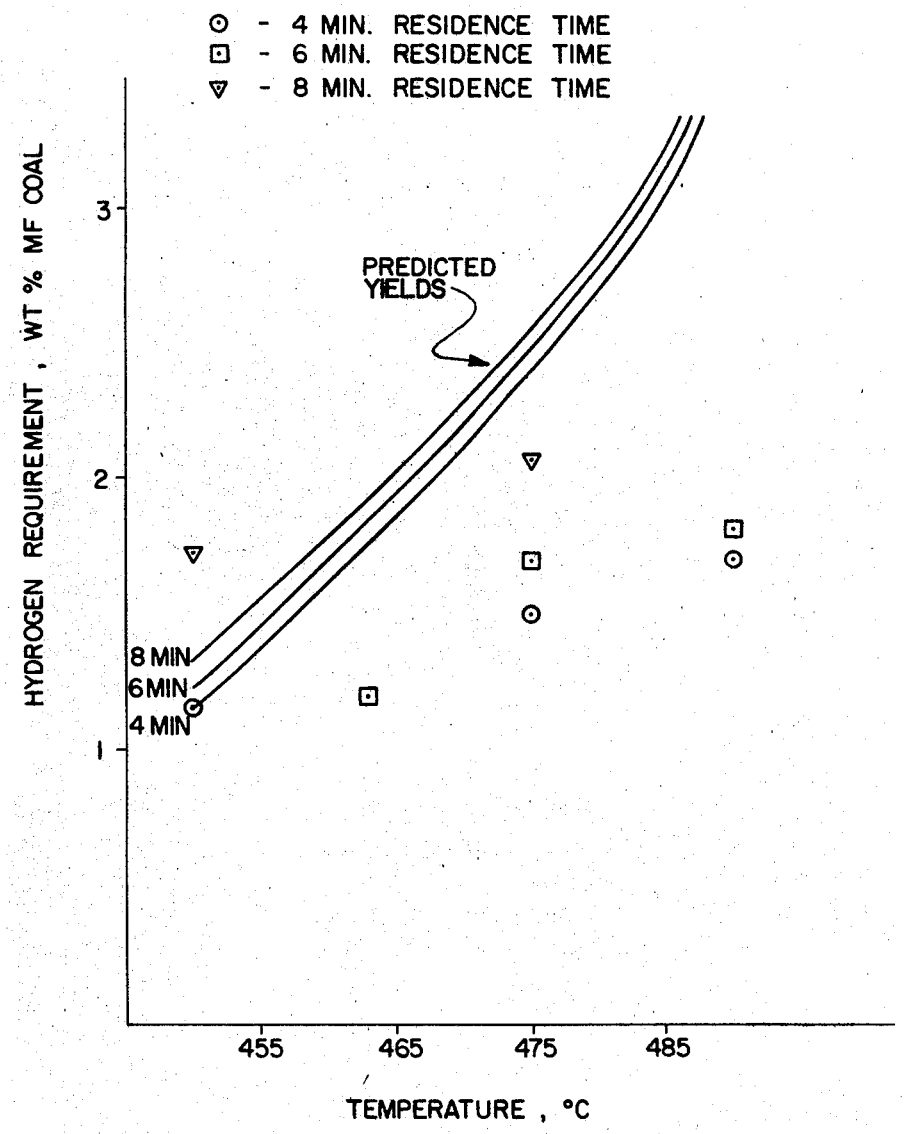
FIGS. 4, 5 and 6 illustrate the unpredictably low hydrogen consumption and correspondingly low $C_1$–$C_4$ and naptha yields, respectively, when operating with the short residence time process of the invention.
Figure 5:
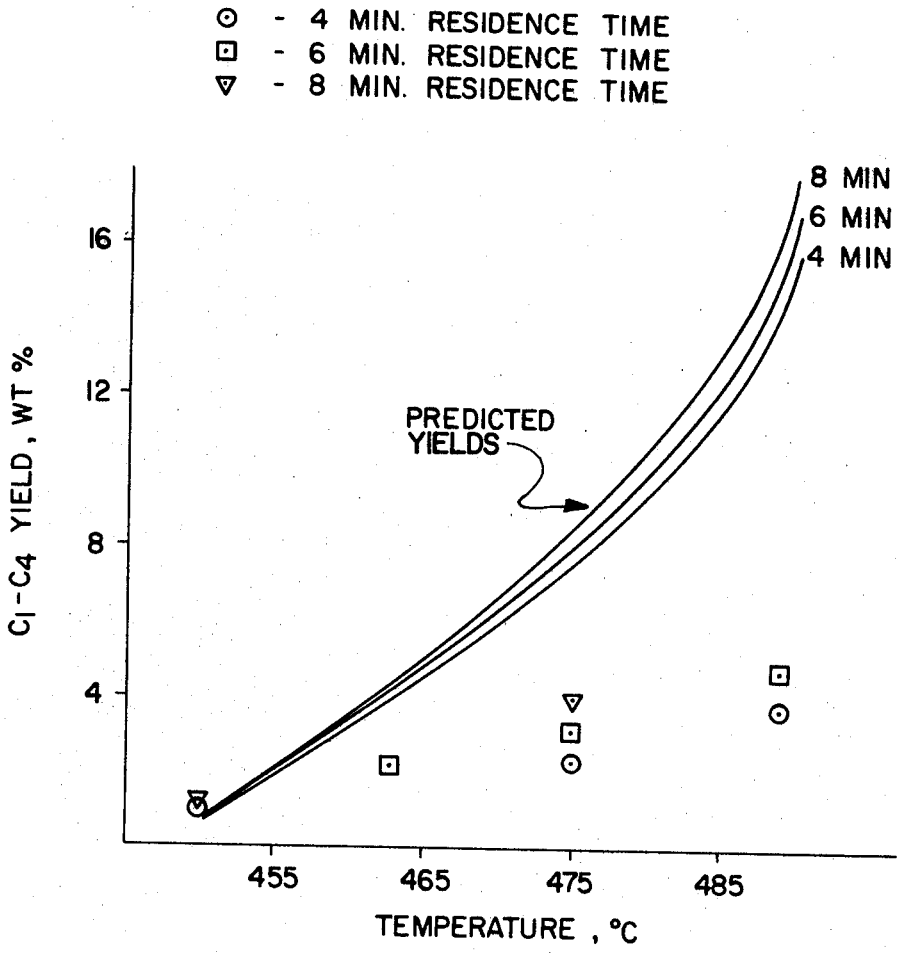
Figure 6:
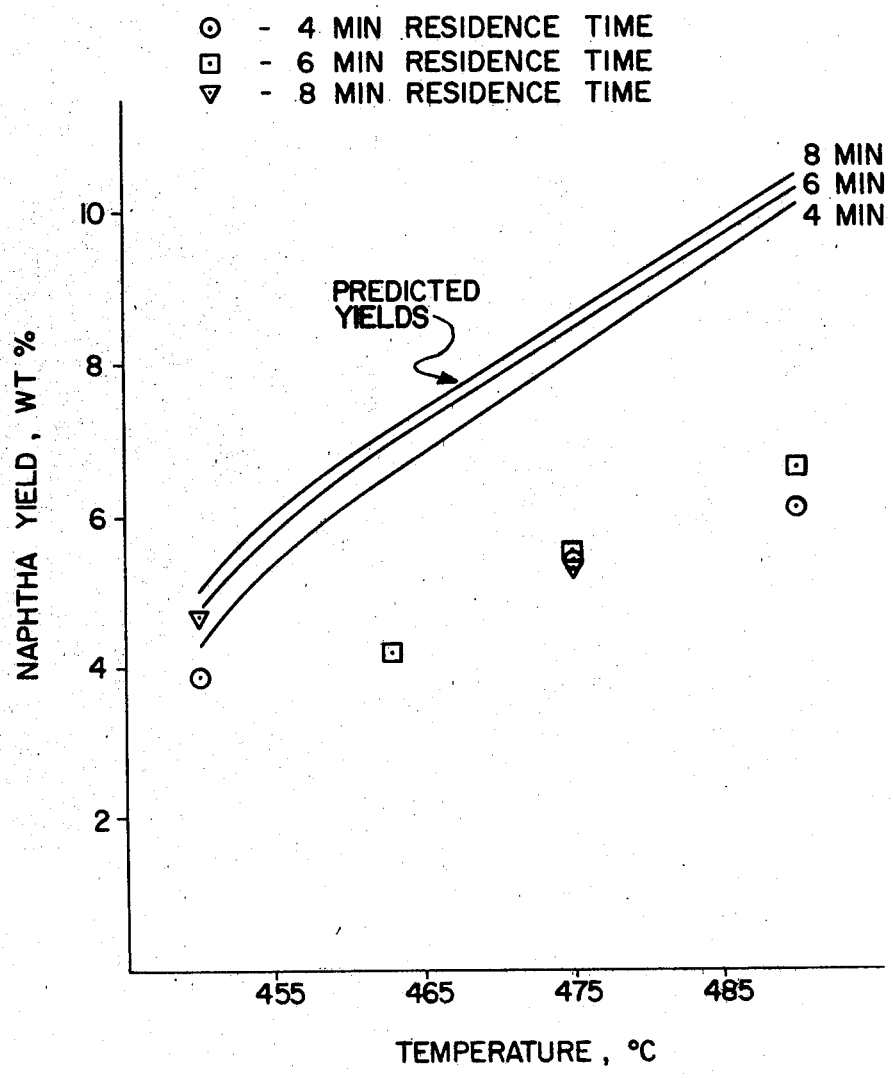

FIGS. 4, 5 and 6 show hydrogen consumption, $C_1$–$C_4$ yield and naphtha yield, respectively, as a function of temperature at residence times of 4, 6 and 8 minutes, while operating under the conditions of FIG. 3. As in the case of FIG. 3, the solid curves of FIGS. 4, 5 and 6 were obtained by mathematical correlation, while the isolated data points represent average hydrogen consumption, $C_1$–$C_4$ yield and naphtha yield, respectively, for several runs at each of the conditions shown.

The hydrogen requirement predicted by the correlation sharply increases with temperature as shown in FIG. 4. Similarly, FIGS. 5 and 6 show a correspondingly sharp increase with temperature in $C_1$–$C_4$ and naphtha yields, respectively. The actual data, however, show that the hydrogen requirement and $C_1$–$C_4$ and naphtha yields are less than predicted and increase at a slower rate, respectively.

EXAMPLE 3

For comparative purposes, tests were conducted at conventional residence times and conditions utilizing portions of a Western Kentucky bituminous coal having the following inspections:

| Elemental Analysis, wt. % (dry basis) | |
|---|---|
| Carbon | 71.1 |
| Hydrogen | 5.0 |
| Sulfur | 3.8 |
| Nitrogen | 1.3 |
| Oxygen | 7.4 |
| Ash | 11.4 |

Separate portions of the coal were mixed with a solvent produced in a process operated at a longer residence time than the present example and subjected to reaction temperatures of 425° C., 450° C. and 475° C., under a hydrogen pressure of 1000 psig at residence times of 24, 30 and 42 minutes, respectively. The results are shown in Table III:

TABLE III

| | Yield, Wt. % Dry Coal Reactor Residence Times | | |
|---|---|---|---|
| | 24 min. | 30 min. | 42 min. |
| Total Distillate | | | |
| 425° C. | — | 9.3 | 11.0 |
| 450° C. | 10.3 | 10.4 | 13.0 |
| 475° C. | 5.0 | 1.0 | 5.1 |
| Recycle Solvent | | | |
| 425° C. | — | −3.6 | −9.6 |
| 450° C. | −7.8 | −9.1 | −11.9 |
| 475° C. | −16.2 | −28.4 | −26.8 |
| Insoluble Organic Matter | | | |
| 425° C. | — | 7.7 | 10.1 |
| 450° C. | 9.5 | 9.4 | 9.4 |
| 475° C. | 11.5 | 12.2 | 10.8 |
| $C_1$—$C_4$ | | | |
| 425° C. | — | 1.8 | 2.7 |
| 450° C. | 2.8 | 3.5 | 5.6 |
| 475° C. | 7.1 | 7.0 | 8.2 |

The data in Table III show that at residence times typical of prior solvent refined coal processes, an increase in temperature from 425° C. to 450° C. increases the total distillate yield slightly, but that a further increase in temperature to 475° C. results in a decrease in total distillate yield. The amount of recycle of solvent obtained is negative throughout and becomes increasingly negative as the temperature is increased throughout the temperature range of 425° C. to 475° C. Table III shows that at a hydrogen pressure of 1000 psig, the detrimental effect on recycle solvent yield upon an increase in temperature from 450° C. to 475° C. is much more pronounced than for a corresponding increase from 425° to 450° C.

The decrease in amounts obtained of total distillate and recycle solvent as the temperature is increased from 450° C. to 475° C. at 1000 psig apparently results from the fact that the rate of hydrocracking of the solvent to gases and the rate of polymerization of dissolved coal to insoluble organic matter increase significantly in this temperature range. The occurrence of polymerization reactions is indicated by an increase in production of insoluble organic matter when the temperature is increased. The occurrence of hydrocracking reactions is indicated by an increase in production of $C_1$–$C_4$ gases when the temperature is increased. For example, at the 30 minutes residence time, the insoluble organic matter increases from 9.4 weight percent to 12.2 weight percent and the $C_1$–$C_4$ gas yield increases from 3.5 weight percent to 7.0 weight percent when the temperature is increased from 450° C. to 475° C.

EXAMPLE 4

The effects of temperature and hydrogen feed rate upon the yield of recycle solvent are demonstrated by the following example. Samples of Kentucky coal were subjected to liquefaction at a hydrogen pressure of 2000 psig, temperatures of 450° and 475° C. and at a residence time of 8 minutes, while utilizing hydrogen feed rates of 1.0 and 2.0 weight percent based upon the total weight of the feed slurry. The results are shown in Table IV:

TABLE IV

| $H_2$ Feed Rate (Wt. %) | Recycle Solvent Yield, Wt. % MF Coal | |
|---|---|---|
| | 450° C. | 475° C. |
| 1.0 | (2.0) | 1.5 |
| 2.0 | 3.0 | 6.0 |

As seen in Table IV, not only temperature but also hydrogen feed rate has a significant effect upon solvent yield. The recycle solvent yield increased with increasing temperature; however, there is also a significant increase in recycle solvent yield with increasing hydrogen feed rate. Thus, at 450° C. and a hydrogen feed rate of 1.0 weight percent based upon the total weight of the slurry, a solvent deficiency of 2.0 weight percent was observed. However, when the hydrogen feed rate was doubled to 2.0 weight percent, the yield of recycle solvent increased to a positive value of 3.0. Similarly, at 475° C. the yield of recycle solvent increased from 1.5 weight percent to 6.0 weight percent, with the increase in hydrogen feed rate, again indicating a significant effect of the hydrogen feed rate upon the yield of recycle solvent. Since the yield of recycle solvent increases with an increase in the hydrogen circulation rate, this example demonstrates the importance of operating the process of the present invention in a continuous manner with sufficient hydrogen being fed continuously to the process.

EXAMPLE 5

The effect of solvent recycle upon the short residence time process of the present invention is demonstrated in the following tests. In these tests, certain samples of Kentucky bituminous coal were mixed with single pass solvent obtained from a conventional solvent refined coal process performed at a longer residence time than that of the present process, while other samples of the same coal were admixed with recycle solvent. All samples were reacted at a temperature of 475° C. under a hydrogen pressure of 2000 psig (140 kg/cm$^2$), a hydrogen feed rate of 1.0 weight percent based on the weight of the feed slurry, which corresponds to a hydrogen rate of 13,000 scf per ton of coal. The residence times were 6 and 8 minutes, respectively. The results are set forth in Table V:

TABLE V

| | Yield, Wt. % MF Coal Reactor Residence Times | | | |
|---|---|---|---|---|
| | 6 min. | | 8 min. | |
| | Single Pass Solvent | Solvent Recycle | Single Pass Solvent | Solvent Recycle |
| $C_1$—$C_4$ | 3.3 | 3.2 | — | 3.8 |
| Recycle Solvent (Loss) | (7.1) | (0.7) | (2.2) | 0.5 |
| Total Distillate | 8.1 | 12.6 | 13.7 | 14.5 |
| Solid Deashed Coal | 66.6 | 63.2 | 63.2 | 61.1 |
| Insoluble Organic Matter | 6.2 | 6.2 | 6.3 | 6.3 |
| % Sulfur in Solid Deashed Coal | •1.04 | 1.08 | 1.01 | 0.94 |
| H Content of Solvent, Wt. % | 7.85 | 7.49 | 7.54 | 7.56 |

As seen in Table V, a direct comparison between the solvent recycle and the single pass solvent runs indicates solvent recycle converts a solvent deficiency to either a reduced solvent deficiency or a positive solvent yield. At a 6 minute residence time, the recycle solvent loss was 7.1 weight percent (on a MF coal basis) in the single pass mode, whereas the loss decreased to 0.7 weight percent in the solvent recycle run. Solvent losses decreased with an increase in residence time from 6 to 8 minutes. In the single pass run with an 8 minute residence time, there was a 2.2 weight percent solvent loss while in the solvent recycle run a slight excess (0.5 weight percent) of recycle solvent was obtained. Such results are highly surprising since they show that the mere act of recycle of solvent in the short residence time process causes the solvent to enhance its own production. These results are even more surprising in view of the $C_1$–$C_4$ yield data in Table V, which show that the enhanced distillate yield is achieved without an increase in $C_1$–$C_4$ yield, indicating that a desirable distillate selectivity is maintained without a high gas yield. A high gas yield is undesirable since it only occurs through a high consumption of hydrogen.

EXAMPLE 6

In order to demonstrate the effect of solvent recycle at an even higher temperature, the procedure of Example 5 was repeated using samples of Kentucky coal at the same hydrogen pressure and feed ratio, but at a reactor temperature of 490° C.

TABLE VI

| | Yield, Wt. % MF Coal Reactor Residence Times | | | |
|---|---|---|---|---|
| | 4 min. | | 6 min. | |
| | Single Pass Solvent | Solvent Recycle | Single Pass Solvent | Solvent Recycle |
| $C_1$—$C_4$ | 4.1 | 3.8 | 5.1 | 4.5 |
| Recycle Solvent (Loss) | (11.9) | (6.1) | (12.2) | (4.2) |
| Total Distillate | 8.0 | 8.2 | 4.1 | 12.2 |
| Solid Deashed Coal | 66.2 | 65.3 | 67.4 | 60.7 |
| Insoluble Organic Matter | 6.8 | 7.2 | 7.5 | 7.3 |
| S Content in Solid Deashed Coal, Wt. % | 0.89 | 1.09 | 0.92 | 1.01 |
| H Content in Solvent, Wt. % | 7.15 | 7.06 | 7.56 | 7.18 |

As seen in Table VI, the residence times used were 4 and 6 minutes. Although recycle solvent losses were observed in each run, the losses in the solvent recycle runs were significantly less than in the single pass runs. In the 4 minute runs, recycle solvent loss decreased from 11.9 to 6.1 percent with solvent recycle, and at 6 minutes, recycle solvent loss decreased from 12.2 to 4.2 percent with solvent recycle. These result are especially surprising in view of the $C_1$–$C_4$ yield data in Table VI which show that gas yield is reduced at the same time distillate yield is increased.

The temperature of the tests of Tables V and VI is higher than the temperature of the process in which the single pass solvent was produced. As expected, Tables V and VI show that the recycle solvent has a generally lower hydrogen content than the single pass solvent. It is particularly surprising that the recycle solvent, having the lower hydrogen content, in all tests provided an improved total distillate yield and a reduced solvent deficiency, because it has heretofore been the experience in the coal liquefaction art that a higher hydrogen content coal derived solvent improved distillate yields in a coal liquefaction process because of its higher content of transferable hydrogen.

EXAMPLE 7

This example demonstrates the advantage of slurry recycle in the short residence time process of the invention. A combination of unfiltered coal solution and distillate recycle solvent was admixed with samples of Kentucky 9/14 coal and Indiana V coal, respectively. The expression "unfiltered coal solution" as used in the examples refers to recycle slurry (a stream comprising mineral residue, normally solid deashed coal and solvent boiling range liquid). The samples were formulated with equal weights of recycle solvent and unfiltered coal solution and were reacted at a temperature of 463° C., under a hydrogen pressure of 2000 psig (140 kg/cm$^2$) for a nominal slurry residence time of 8.0 minutes. The hydrogen feed was 2.0 weight percent based upon the weight of the slurry, corresponding to 25,000 SCF per ton of coal. The results are shown in Table VII:

TABLE VII

| | Kentucky 9/14 | | | Indiana V | |
|---|---|---|---|---|---|
| Test No. | 1 | 2 | 3 | 4 | 5 |
| Slurry Formation | | | | | |
| Feed Coal, Wt. % | 30.0 | 30.0 | 40.0 | 30.0 | 30.0 |
| Recycled Solvent, Wt. % | 70.0 | 35.0 | 30.0 | 70.0 | 35.0 |
| Unfiltered Coal Solution, | | | | | |

TABLE VII-continued

| Test No. | Kentucky 9/14 1 | 2 | 3 | Indiana V 4 | 5 |
|---|---|---|---|---|---|
| Wt. % | — | 35.0 | 30.0 | — | 35.0 |
| Yields, Wt. % MF Coal Basis | | | | | |
| $C_1$—$C_4$ | 2.9 | 3.9 | 3.5 | 2.8 | 3.6 |
| Recycle Solvent | 2.9 | 2.5 | 8.7 | 1.3 | 7.8 |
| Total Distillate | 13.0 | 14.9 | 19.2 | 15.4 | 17.5 |
| Solid Deashed Coal | 62.4 | 58.6 | 53.8 | 63.3 | 59.5 |
| Insoluble Organic Matter | 5.5 | 5.7 | 7.0 | 4.9 | 4.8 |
| S Content in Solid Deashed Coal, Wt. % | 1.25 | 1.10 | 1.16 | 0.73 | 0.63 |

As seen in Table VII of the recycle slurry tests, Tests 2 and 5 utilize a feed coal concentration of 30 weight percent, while in Test 3, the feed coal concentration was increased to 40 weight percent. Tests 1 and 4 were conducted without slurry recycle.

Test 3 was conducted under the same conditions as Test 2 with the exception that the raw coal concentration in the feed slurry was increased to 40 weight percent. Inspite of the fact that the capacity of the system was thereby increased, recycle solvent in the amount of 8.7 weight percent based on feed coal was achieved, which is considerably greater than the 2.5 weight percent solvent obtained with a 30 percent coal concentration.

Tests 4 and 5 with Indiana V coal show an increase from 1.3 weight percent of excess recycle solvent to 7.8 weight percent of excess recycle solvent, thus indicating a significant improvement in recycle solvent obtained with slurry recycle.

Additionally, the use of slurry recycle resulted in improvement in desulfurization in the case of both Kentucky and Indiana coals.

It is noted that in no test was the amount of slurry recycle sufficiently high to induce a solid deashed coal yield as low as 50 weight percent.

EXAMPLE 8

In order to demonstrate the effect of increasing temperature in a system utilizing slurry recycle, eight tests were conducted using Kentucky 9/14 coal under a hydrogen pressure of 2000 psig (140 kg/cm$^2$), temperatures of 465° C. and 485° C., while at residence times of 5 and 10 minutes, respectively. The results are shown in Table VIII:

The results of Table VIII show that a greater amount of recycle solvent is achieved when the amount of unfiltered coal solution is increased. Comparing Tests 1 and 2, which were performed at 465° C., it is seen that a recycle solvent yield of 4.9 weight percent was achieved in Test 1 using a greater amount of recycle slurry (45 weight percent) as compared with Test 2 in which only 1.9 percent excess solvent was achieved using 35 weight percent recycle slurry. Comparing Tests 3 and 4, which were performed at 485° C., it is seen that a recycle solvent yield of 1.4 weight percent was achieved in Test 4 using a greater amount of recycle slurry (45 weight percent) as compared with Test 3 in which a very slight solvent deficiency of −0.6 weight percent was achieved using 35 weight percent recycle slurry.

Although the invention has been described in considerable detail with particular reference to certain preferred embodiments thereof, variations and modifications can be effected within the spirit and scope of the invention as described hereinbefore, and as defined in the appended claims.

What is claimed is:

1. A process for producing a normally solid dissolved coal product and a distillate liquid product from a raw coal feed which comprises continuously passing a feed slurry comprising said raw coal and a recycle solvent oil together with hydrogen through a preheating-reaction zone, the hydrogen pressure in said preheating-reaction zone being at least 1500 psig, reacting said slurry in said preheating-reaction zone at a temperature in the range of between about 455° and about 500° C. to dissolve said coal to form normally liquid coal and normally solid dissolved coal, maintaining a total slurry residence time within said temperature range at a finite value in the range of above 0 to about 0.2 hour, continuously withdrawing reaction effluent, continuously and directly contacting said reaction effluent with a quenching fluid to substantially immediately reduce the temperature of said reaction effluent to a temperature which is sufficiently below 425° C. to substantially inhibit polymerization so that the yield of insoluble organic matter comprises less than 9 weight percent of said feed coal on a moisture free basis, performing said reaction under conditions of temperature, hydrogen pressure and residence time such that the distillate liquid product boiling within the range $C_5$ to 454° C. is an

TABLE VIII

| Test No. | 1 | 2 | 3 | 4 | 5 | 6 | 7 | 8 |
|---|---|---|---|---|---|---|---|---|
| Nominal Slurry Residence Time, minutes | 5.1 | 5.1 | 5.1 | 5.1 | 10.0 | 10.1 | 10.2 | 10.1 |
| Slurry Formation | | | | | | | | |
| Coal, Wt. % | 30.0 | 30.0 | 30.0 | 30.0 | 30.0 | 30.0 | 30.0 | 30.0 |
| Recycle Solvent, Wt. % | 25.0 | 35.0 | 35.0 | 25.0 | 35.0 | 35.0 | 25.0 | 25.0 |
| Unfiltered Coal Solution, Wt. % | 45.0 | 35.0 | 35.0 | 45.0 | 35.0 | 35.0 | 45.0 | 45.0 |
| Hydrogen Feed Rate | | | | | | | | |
| Wt. % Based on Slurry | 2.06 | 2.08 | 2.06 | 2.06 | 2.02 | 2.04 | 2.05 | 2.04 |
| MSCF/Ton of Coal | 26.1 | 26.3 | 26.0 | 26.2 | 25.5 | 25.8 | 25.9 | 25.7 |
| Normal Dissolver Temp., °C. | 465 | 465 | 485 | 485 | 465 | 485 | 465 | 485 |
| Yields, Wt. % Based on MF Coal | | | | | | | | |
| $C_1$-$C_4$ | 3.3 | 2.9 | 5.5 | 5.6 | 4.8 | 8.4 | 4.8 | 8.3 |
| Excess Recycle Solvent (or loss), >249° C. | 4.9 | 1.9 | (0.6) | 1.4 | 2.2 | (2.2) | 7.3 | (0.4) |
| Total Distillate | 15.1 | 11.4 | 11.3 | 13.0 | 13.7 | 12.8 | 17.6 | 12.1 |
| Solid Deashed Coal | 60.3 | 64.0 | 59.4 | 56.6 | 59.3 | 55.3 | 55.2 | 54.9 |
| Insoluble Organic Matter | 6.3 | 6.3 | 7.4 | 8.7 | 5.7 | 7.0 | 5.9 | 9.6 |
| S Content in Solid Deashed Coal Wt. % | 0.94 | 0.88 | 0.91 | 0.80 | 1.12 | 0.98 | 1.05 | 0.94 |

amount at least equal to that obtainable by performing said process under the same conditions except for a total slurry residence time of 0.3 hour before quenching, separating said reaction effluent into fractions without hydrogenative reaction of said reaction effluent subsequent to quenching and before said separation step, one fraction comprising solvent boiling range liquid and a second fraction comprising normally solid dissolved coal, the yield of said solid dissolved coal product comprising at least 30 weight percent of said coal feed on a moisture-free basis, recycling said solvent boiling range liquid as recycle solvent for mixing with said feed coal without any hydrogenative reaction thereof following said quenching step, the amount of said solvent boiling range liquid being sufficient to provide at least 80 weight percent of that required to maintain said process in overall solvent balance.

2. The process of claim 1, wherein said preheating-reaction zone comprises a first zone and a second zone, wherein said first zone is heated and said second zone is unheated.

3. The process of claim 2, wherein said first zone is a tubular zone.

4. The process of claim 1, wherein said preheating-reaction zone is a tubular zone.

5. The process of claim 1, wherein said reaction effluent is passed to a separation zone for separation of gases from said reaction effluent.

6. The process of claim 5, wherein said reaction effluent is contacted with said quenching fluid before entering said separation zone.

7. The process of claim 5, wherein said reaction effluent is contacted with said quenching fluid upon entering said separation zone.

8. The process of claim 1, wherein said quenching fluid is a cool distillate liquid.

9. The process of claim 6, wherein said quenching fluid is a cool distillate liquid.

10. The process of claim 1, wherein said distillate liquid product is produced in an amount at least equal to that obtainable by performing said process under the same conditions except for a total slurry residence time of 0.4 hour.

11. The process of claim 1, wherein said distillate liquid product is produced in an amount at least equal to that obtainable by performing said process under the same conditions except for a total slurry residence time of 0.5 hour.

12. The process of claim 1, wherein the amount of said solvent boiling range liquid is sufficient to provide at least 90 weight percent of the amount required to maintain said process in overall solvent balance.

13. The process of claim 1, wherein the amount of said solvent boiling range liquid is sufficient to provide at least 100 weight percent of the amount required to maintain said process in overall solvent balance.

14. The process of claim 1, wherein the solid dissolved coal yield comprises at least 40 weight percent of said coal feed on a moisture free basis.

15. The process of claim 1, wherein said fraction comprising normally solid dissolved coal product is passed to a filtration step.

16. The process of claim 1, wherein said solid dissolved coal product is passed to a solvent extraction step.

17. The process of claim 1, wherein said temperature is in the range of 460° to 490° C., said hydrogen pressure is in the range of 2000 to 2500 psig and said residence time is in the range of 0.02 to 0.15 hour.

18. The process of claim 17, wherein said selected temperature is about 475° C., said hydrogen pressure about 2000 psig and said residence time is between about 0.06 and about 0.135 hour.

19. The process of claim 1, wherein said second fraction comprises normally solid dissolved coal, mineral residue and solvent boiling range liquid, and at least a portion of said second fraction is recycled.

20. The process of claim 19, wherein said portion of said second fraction constitutes between about 20 and about 70 weight percent based upon the weight of said feed slurry.

21. The process of claim 1, wherein said yield of insoluble organic matter comprises less than 8 weight percent.

22. The process of claim 1, wherein said yield of insoluble organic matter comprises less than 7.5 weight percent.

23. The process of claim 1, wherein the hydrogen consumption of said process is between about 0.5 and about 2.5 weight percent of said coal feed on a moisutre free basis.

24. The process of claim 1, wherein the hydrogen feed rate to said preheated-reaction zone is between about 0.5 and about 6.0 weight percent based upon the weight of the feed slurry.

25. The process of claim 24, wherein said hydrogen feed rate is between about 1.5 and about 4.0 weight percent based upon the weight of the feed slurry.

26. A process for producing a normally solid dissolved coal product and a distillate liquid product from a raw feed coal which comprises continuously passing a feed slurry comprising said raw coal and a recycle solvent oil together with hydrogen through a preheating-reaction zone, said preheating-reaction zone comprising a first heated zone and a second, sequential unheated zone, the hydrogen pressure in said preheating-reaction zone being at least 1500 psig, reacting said slurry in said preheating-reaction zone at a temperature in the range of between about 455° and about 500° C. to dissolve said coal to form normally liquid coal and normally solid dissolved coal, maintaining a total slurry residence time within said temperature range at a finite value in the range of above 0 to about 0.2 hour, continuously withdrawing reaction effluent, continuously and directly contacting said reaction effluent with a quenching fluid to substantially immediately reduce the temperature of said reaction effluent to a temperature which is sufficiently below 425° C. to substantially inhibit polymerization, performing said reaction under conditions of temperature, hydrogen pressure and residence time such that the distillate liquid product boiling within the range $C_5$ to 454° C. is an amount at least equal to that obtainable by performing said process under the same conditions except for a total slurry residence time of 0.3 hour before quenching, passing said quenched effluent to a separation step without hydrogenative reaction thereof, separating said reaction effluent into fractions without hydrogenative reaction of said reaction effluent subsequent to quenching and before said separation step, one fraction comprising solvent boiling range liquid and a second fraction comprising normally solid dissolved coal, the yield of said solid dissolved coal product comprising at least 30 weight percent of said coal feed on a moisture free basis, recycling said solvent boiling range liquid as recycle solvent for mixing with said feed coal without any hydrogenative reaction thereof following said quenching step, the amount of said solvent boiling range liquid being sufficient to provide at least 80 weight percent of that required to maintain said process in overall solvent balance.

* * * * *

UNITED STATES PATENT AND TRADEMARK OFFICE

CERTIFICATE OF CORRECTION

PATENT NO. : 4,328,088

DATED : May 4, 1982

INVENTOR(S) : R. P. Anderson, D.K. Schmalzer, C.H. Wright

It is certified that error appears in the above-identified patent and that said Letters Patent are hereby corrected as shown below:

In the References Cited, U.S. Patent Documents, add --3,477,941 Nelson--.

Column 1, line 7, "AC01-79ET4800" should read --AC01-79ET14800--;
line 37, "solid-liquid" should read --solids-liquid--.

Column 2, line 64, "reaction" should read --reactor--.

Column 3, line 18, "about" should read --above--;
line 55, "slid" should read --solid--;
line 63, "tempuratur" should read --temperature--.

Column 4, line 15, "ablilty" should read --ability--;
line 50, "conventinal" should read --conventional--.

Column 5, line 6, "naptha" should read --naphtha--;
line 19, "referred" should read --preferred--;
line 53, "ay" should read --any--.

Column 7, line 53, "distilate" should read --distillate--.

Column 12, line 50, "were" should read --are--.

Column 20, line 18, "moisutre" should read --moisture--.

Signed and Sealed this

*Twenty-sixth* Day of *October 1982*

[SEAL]

*Attest:*

GERALD J. MOSSINGHOFF

*Attesting Officer*

*Commissioner of Patents and Trademarks*